United States Patent [19]

Greenberg

[11] Patent Number: 4,805,838

[45] Date of Patent: Feb. 21, 1989

[54] WATER SPRINKLER

[75] Inventor: Ilan Greenberg, Haifa, Israel

[73] Assignees: Plastro Gvat, Kibbutz Gvat; Agroteam Consultants Ltd., Ramat Eshai, both of Israel

[21] Appl. No.: 230,668

[22] Filed: Aug. 9, 1988

Related U.S. Application Data

[63] Continuation of Ser. No. 006,999, Jan. 27, 1987, abandoned.

[30] Foreign Application Priority Data

Jan. 31, 1987 [IL] Israel ..... 77747

[51] Int. Cl.[4] ..... B05B 3/08

[52] U.S. Cl. ..... 239/222.17; 239/233

[58] Field of Search ..... 239/DIG. 1, 240–242, 239/255, 230–233, 214, 251, 261, 222.11, 222.13, 222.15, 222.17, 222.19

[56] References Cited

U.S. PATENT DOCUMENTS

| | | | |
|---|---|---|---|
| 1,621,264 | 3/1927 | Humphrey | 239/255 |
| 1,712,523 | 5/1929 | Schneider | 239/255 X |
| 2,729,504 | 1/1956 | Zikas | 239/DIG. 1 |
| 3,432,102 | 3/1909 | Turner et al. | 239/255 X |
| 3,664,586 | 5/1972 | Harris | 239/253 |
| 4,253,608 | 3/1981 | Hunter | 239/242 X |

*Primary Examiner*—Andres Kashnikow
*Assistant Examiner*—Kevin P. Weldon
*Attorney, Agent, or Firm*—Benjamin J. Barish

[57] ABSTRACT

A water sprinkler, comprises a distributor head and a direction-reversing member movably mounted with respect to the distributor head. The latter member includes first and second surfaces impinged by the water jet in first and second positions of the direction-reversing member, a third surface contactable with the distributor head for rotating it in one direction when the first surface is impinged by the water jet, and a fourth surface contactable with the distributor head for rotating it in the opposite direction when the second surface is impinged by the water jet. The sprinkler further includes an abutment, and a pair of stops engageable by the abutment after the distributor head has been rotated a predetermined distance in the one or opposite direction, to switch the direction of rotation of the distributor head.

16 Claims, 3 Drawing Sheets

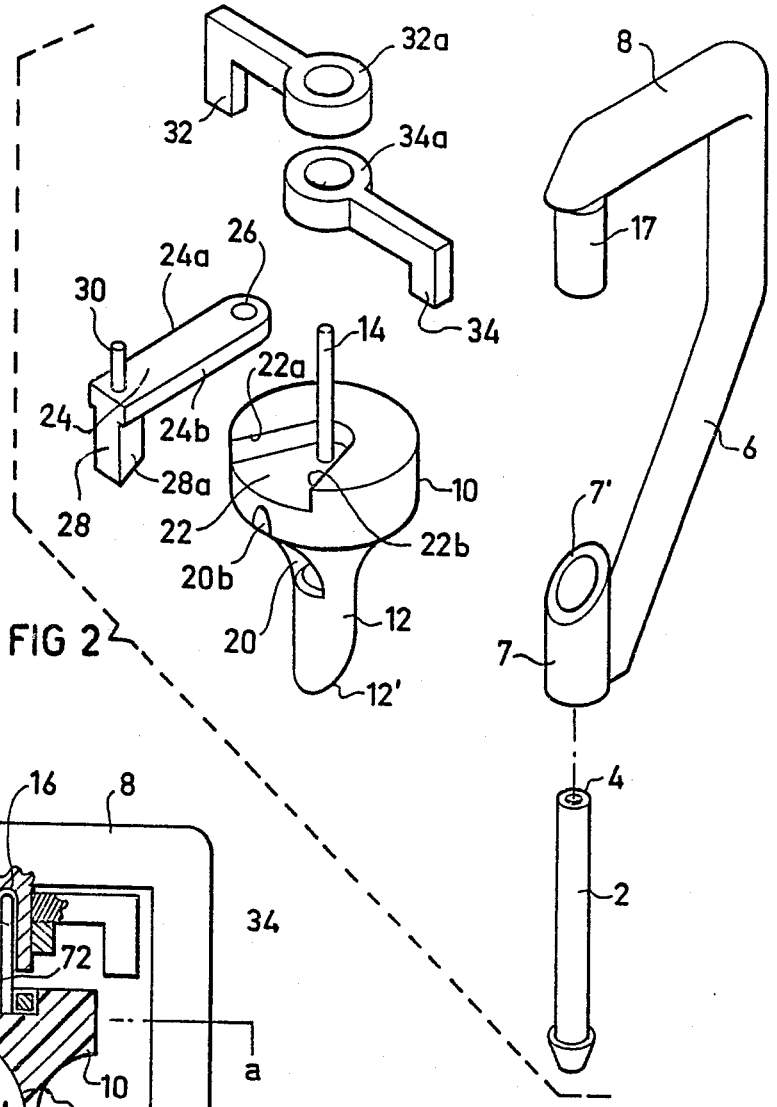
FIG 2
FIG 1
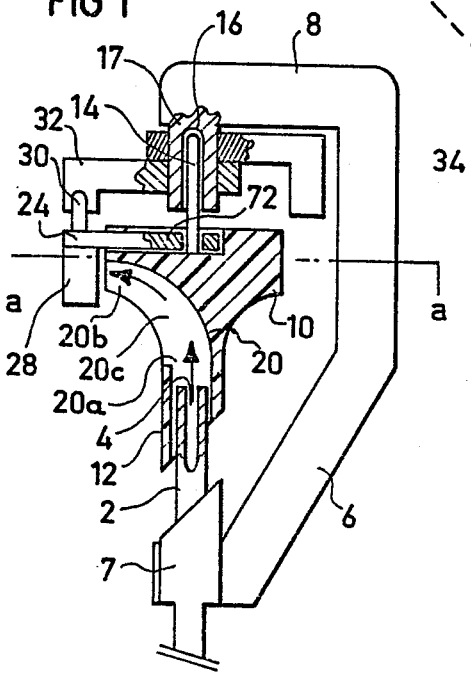
FIG 1a
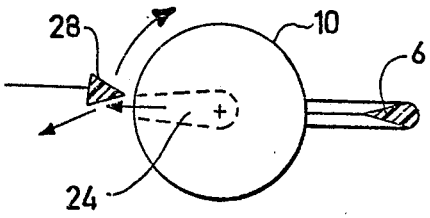

FIG 3a
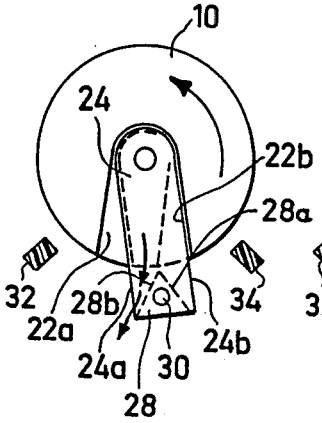
FIG 3b
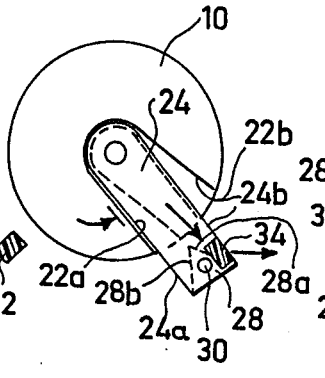
FIG 3c
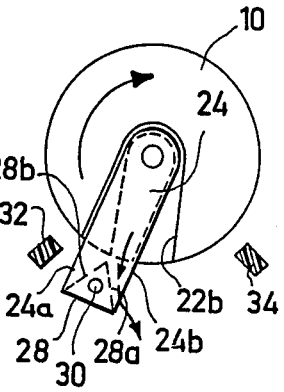
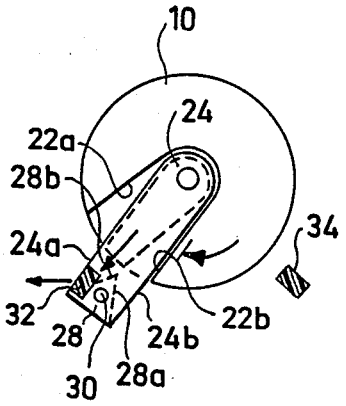
FIG 3d
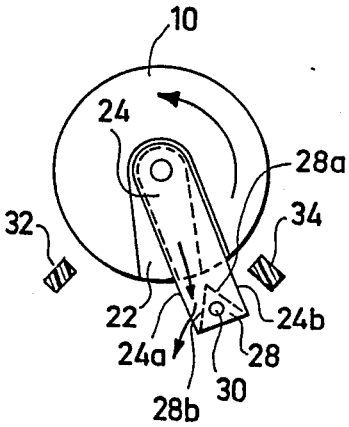
FIG 3e

WATER SPRINKLER

This application is a continuation of application Ser. No. 006,999, filed Jan. 27, 1987, now abandoned.

RELATED APPLICATIONS

The present application is related to copending patent applications Ser. Nos. 07/006,966 and 07/007,105, both filed the same date as the present application and both assigned to the same assignee as the present application.

BACKGROUND OF THE INVENTION

The present invention relates to water sprinklers, and particularly to water sprinklers which can be operated as a sector-type sprinkler to wet only a predetermined sector, or as a conventional full-circle sprinkler.

Sector-type water sprinklers are commonly used where it is desired to distribute the water over a predetermined sector, rather than completely around the sprinkler. The predetermined sector may be, for example, the location of a tree to be irrigated by the water, or the outer edge or corner of a land plot to be irrigated. Many sector type sprinklers have been designed and are now in use, but efforts are continuously being made to simplify their construction so as to permit their manufacture and assembly in volume and at low cost.

SUMMARY OF THE INVENTION

An object of the present invention is to provide a new sprinkler constructed of a few relatively simple parts which can be manufactured and assembled in volume and at relatively low cost.

According to the present invention, there is provided a water sprinkler comprising a nozzle connected to a water supply pipe and discharging the water in the form of a water jet; a distributor head mounted on the sprinkler for rotary movement with respect to the nozzle and formed with a passageway aligned with the nozzle to receive the water jet therefrom and to direct it outwardly of the sprinkler; and a direction-reversing member pivotally mounted at one end the distributor head, and including a first surface impinged by the outwardly directed water jet in a first position of the direction-reversing member, and a second surface impinged by the outwardly directed water jet in a second position of the direction-reversing member. The direction-reversing member further includes a third surface contactable with the distributor head for rotating it in one direction when the first surface is impinged by the water jet, and a fourth surface contactable with the distributor head for rotating it in the opposite direction when the second surface is impinged by the water jet. The water sprinkler further includes an abutment mounted on the opposite end (i.e., the end opposite to its pivotal mounting) of the direction-reversing member; a first stop engageable by the abutment after the distributor head has been rotated a predetermined distance in the first direction, and effective to move the direction-reversing member from the first position to the second position; and a second stop engageable by the abutment after the distributor head has been rotated a predetermined angular distance in the opposite direction, and effective to move the direction-reversing member from the second position to the first position to rotate the distributor head in the first direction.

According to further features in the preferred embodiment of the invention described below, the direction-reversing member is pivotably mounted in a radial slot formed in the distributor head, one side face of the direction-reversing member constituting the third surface and contactable with one side face of the slot for rotating the distributor head in the first direction; the opposite side face of the direction-reversing member constituting the fourth surface and contactable with the opposite side face of the slot for rotating the distributor head in the opposite direction. In addition, the direction-reversing member is pivotably mounted at one end to the sprinkler along the rotary axis of the distributor head; the opposite end of the direction-reversing member including a jet-impinging element of triangular configuration with the triangular apex facing the pivotable mounting on the direction-reversing member such that one side face of the triangular jet-impinging element on one side of the apex constitutes the first surface, and the other side of the triangular jet-impinging element on the other side of the apex constitutes the second surface.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a side view, partly in section, illustrating one form of sprinkler constructed in accordance with the present invention;

FIG. 1*a* is a diagrammatic view, along lines a—a of FIG. 1, helpful in explaining the operation of the sprinkler of FIG. 1;

FIG. 2 is an exploded perspective view illustrating the main components of the sprinkler of FIG. 1;

FIGS. 3*a*–3*e* are diagrammatic views illustrating the operation of the sprinkler of FIG. 1;

DESCRIPTION OF PREFERRED EMBODIMENTS

Figure 4:
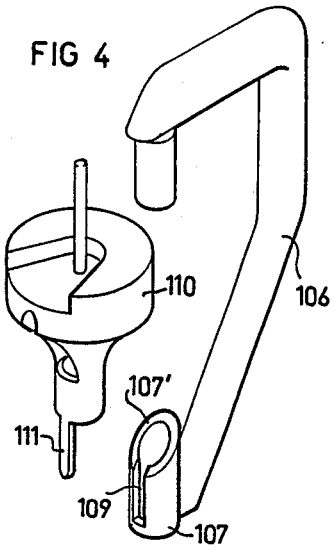
FIG. 4 is an exploded perspective view illustrating a modified construction in the sprinkler of FIGS. 1 and 2.

The sprinkler illustrated in FIGS. 1 and 2 comprises a vertically extending tube 2 connectable to a water supply pipe (not shown) and formed at its upper end with a nozzle 4 through which the water is discharged in the form of a vertical jet as shown by the arrows in FIG. 1. A bracket 6 is carried by an inlet fitting 7 mounted to tube 2, and has a horizontal bracket arm 8 overlying nozzle 4.

A distributor head 10 is rotatably mounted between nozzle 4 and bracket arm 8. For this purpose, the lower end of distributor head 10 is formed with a depending tubular sleeve 12 receiving nozzle 4, and the upper end of distributor head 10 carries a stem 14 receivable within a socket 16 formed in a depending cylindrical boss 17 in bracket arm 8.

Distributor head 10 is further formed with a passageway 20 for receiving the water jet issuing from nozzle 4 and for directing it outwardly of the sprinkler. For this purpose, a passageway 20 includes an axially extending inlet 20*a* joined to a radially extending outlet 20*b* by a curved juncture 20*c*.

As shown particularly in FIG. 2, distributor head 10 is of circular configuration and its upper surface is formed with a slot 22 in the area overlying the passageway outlet 20*b* and extending a short distance on the opposite sides of this outlet. Slot 22 is of generally sector configuration, the slot being defined by two flat side faces 22*a*, 22*b* and a curved juncture spaced a short distance from stem 14.

A member 24 of generally rectangular configuration is pivotably mounted within slot 22 by an opening 26 formed in one end of the member and receiving stem 14 of the distribution head. Member 22 is of a length longer than the radius of distributor head 20 so that the outer end of member 24 projects past the outer face of the distributor head. This outer end of member 24 carries a jet-impinging element 28 depending below member 24 so as to be impinged by the water jet issuing from outlet 20*b* of the water passageway 20 formed in the distributor head 10.

Pivotably mounted member 24 serves as a direction-reversing member in that it is effective to reverse the direction of rotation of the distributor head 10 during the operation of the sprinkler. As shown particularly in FIG. 1*a*, jet-impinging element 28 is of triangular configuration, with the triangular apex facing stem 14 serving as the pivot mounting for member 24. As will be described more particularly below, side face 28*a* on one side of the triangular apex serves as a first surface impinged by the outwardly directed water jet in a first position of the direction-reversing member 24, and side face 28*b* (FIGS. 3*a*–3*c*) on the opposite side of the triangular apex serves as a second surface impinged by the water jet in a second position of the direction-reversing member 24.

The side faces 24*a*, 24*b* of the direction-reversing member 24 are flat, and cooperate with the flat side faces 22*a* and 22*b*, respectively, of slot 22 formed in the distributor head 10. Thus, flat surface 24*a* of member 24 is contactable with flat surface 22*a* of the distributor head to rotate the distributor head in one direction (clockwise in FIG. 2) when the water jet issuing from outlet 20*b* impinges face 28*a* of the jet-impinging element 28; and flat face 24*b* of member 24 contacts flat face 22*b* of the slot 22 when the jet issuing from outlet 22*b* impinges against face 28*b* of the jet-impinging element 28 to rotate the distributor head 10 in the opposite direction (counter-clockwise in FIG. 2).

It will thus be seen that direction-reversing member 24, contacting the sides of slot 22 of the distributor head 10, also rotates with the distributor head. The outer end of member 24 includes an abutment in the form of a pin 30, projecting upwardly from its upper surface engageable with a pair of stops 32, 34 disposed on the opposite sides of the abutment pin. The two stops 32, 34, are each integrally formed with a ring, 32*a*, 34*a*, respectively, frictionally received over boss 17 depending from bracket arm 8 in which is formed socket 16 receiving stem 14 of the distributor head 10. Stops 32 and 34 may be manually preset on opposite sides of abutment pin 30, and once preset, are frictionally retained in position to fix the outer boundaries of the sector to be wetted by the water jet issuing from outlet 20*b*.

The sprinkler illustrated in FIGS. 1 and 2 operates as follows:

When the water is turned off, distributor head 10 rests by gravity with the lower face of its inlet sleeve 12 resting against the upper face 7′ (FIG. 2) of fitting 7 carried by the inlet tube 2, and with stem 14 received within socket 16 but spaced from the bottom of the socket.

When the water is turned on, the water jet issuing from nozzle 4 enters passageway 20 of the distributor head 10 and lifts the distributor head until stem 14 limits against the bottom of socket 16. This also lifts the direction-reversing member 24 to being its abutment pin 30 to the same level as the two stops 32, 34, which had been previously preset to define the boundaries of the sector to be watered by the sprinkler. During the operation of the sprinkler, abutment pin 30 cooperates with the two stops 32 and 34 to oscillate distributor head 10 within the sector defined by the two stops 32, 34 in the following manner as illustrated in FIGS. 3*a*–3*e*.

Assuming the parts are in the position illustrated in FIG. 3*a*, it will be seen that the water jet issuing from outlet 20*b* impinges against face 28*b* of the triangular jet-impinging element 28 carried at the end of the direction-reversing member 24. The force of the jet therefore pivots member 24 to bring its flat surface 24*b* against the flat face 22*b* of slot 22 formed in the distributor head 10 to rotate the distributor head counter-clockwise as shown by the arrow in FIG. 3*a*.

The distributor head 10 is rotated until abutment pin 30 of the direction-reversing member 24 engages stop 34 (FIG. 3*b*), whereupon member 24 is restrained from further rotation while the distributor head 10 continues to rotate a short distance until face 22*a* of its slot 22 engages face 24*a* of member 24. In this condition of the sprinkler, face 28*a* of element 28 is now impinged by the water jet, so that the jet causes flat surface 24*a* of member 24 to contact the flat face 22*a* of slot 22, to thereby rotate the distributor head 10 in the reverse direction, namely clockwise (FIG. 3*c*). This continues until abutment pin 30 engages stop 32 (FIG. 3*d*), whereupon the movement of member 28 is restrained while the distributor head 10 continues for a short distance until surface 22b of its slot 22 comes into contact with face 24*b* of member 24, at which time face 28*b* of element 28 is now impinged to drive distributor head 10 in the clockwise direction (FIG. 3*e*).

The distributor head 10 is thus oscillated back and forth through an arc determined by the settings of the two presettable stops 32, 34, to distribute the water only in the sector defined by those stops.

When the water supply is terminated, the distributor head 10 drops back by gravity onto the inlet fitting 7. The slanted cam surface 12′ (FIG. 2) on the distributor head 10, and the slanted surface 7′ on the inlet fitting 7, assure that the jet outlet 20*b* of the distributor head will be properly oriented when the water is turned on.

Figure 4A:
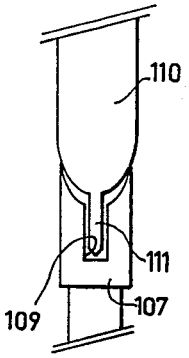
FIGS. 4*a*–4*c* illustrate the starting operation in the modified construction of FIG. 4.
Figure 4B:
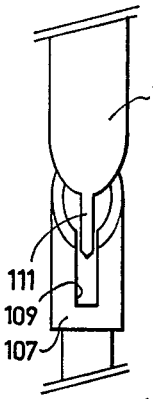
Figure 4C:
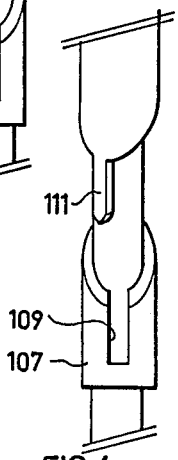

FIG. 4 illustrates a modification to better assure proper starting of the sprinkler after the water has been turned off. Thus, in the modification illustrated in FIG. 4, the fitting 107 receiving the depending end of the distributor head 110 is formed with a vertically-extending slot 109 adapted to receive a lug 111 formed in the lower end of the distributor head. When the water is turned off, distributor head 110 drops by gravity onto the slanted face 107′ of fitting 107, with lug 111 received within slot 109, as shown in FIG. 4*a*. When the water is turned on, slot 109 forces the distributor head 110 to move first in the vertical upward direction (FIG. 4*b*), and, only after lug 111 has cleared slot 109, then to pivot either leftwardly or rightwardly (FIG. 4*c*) according to the position of the direction-changing member (24, FIGS. 1–3) as described above. The modification of FIG. 4 thus better assures that the abutment (30, FIGS. 1–3) in the direction-changing member (24) will forcibly impact against one of the two stops (32, 34) and thereby better assures proper starting of the sprinkler.

Figure 5:
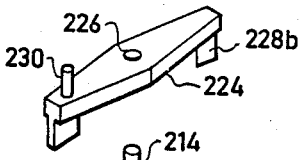
FIGS. 5, 5*a* and 5*b* illustrate a modification in the sprinkler, FIG. 5 being an exploded three-dimensional view illustrating a modified distributor head, FIG. 5*a* being a sectional view illustrating the sprinkler nozzle and distributor head, and FIG. 5*b* illustrating the wetting pattern produced by the modified sprinkler.
Figure 5:
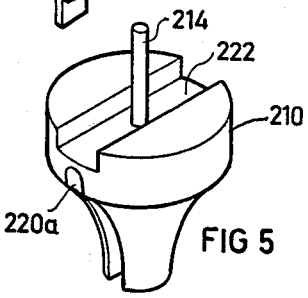
Figure 5A:
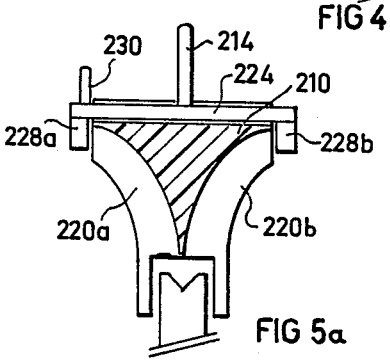
Figure 5B:
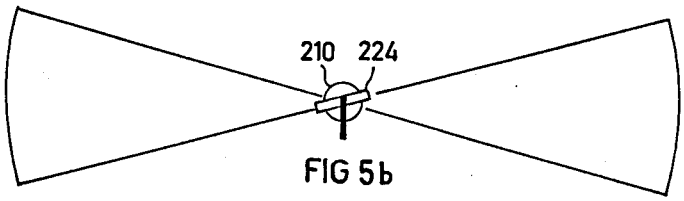

FIGS. 5, 5*a* and 5*b* illustrate a modification, wherein the distributor head, therein designated 210, is formed with two diametrically-opposed passageways 220*a*, 220*b*. In addition, the slot 222 formed in the upper face of the distributor head extends completely across the diameter of the distributor head in alignment with the outlets of the two passageways 220*a*, 220*b*; and the direction-reversing member 224 is formed with two jet-impinging elements 228*a*, 228*b* adapted to be impinged by the water jets issuing from the two slots 220*a*, 220*b*, respectively. Each half of the direction-reversing member 224 on the opposite side of its opening 226, pivotably mounting this member to stem 214 of the distributor head, is of generally triangular shape. In addition slot 222 formed in the outer face of the distributor head is constituted of two aligned radial slots of generally rectangular shape, so that the sides of the direction-reversing member 224 cooperates with the side faces of slot 222 in the same manner as described above, particularly with respect to FIGS. 3*a*–3*e*. Also the abutment pin 230, of which only one is provided in alignment with jet-impinging element 228*a*, cooperates with the stops (not shown) disposed on the opposite sides of the abuttment pin for reversing the direction of rotation of the sprinkler. A sprinkler constructed with the distributor head of FIGS. 5, 5*a* and 5*b* will thus operate in the same manner as described above, but will produce two diametrically-opposed sector wetting patterns, as illustrated in FIG. 5*b*.

It will be appreciated that the stops 32, 34 may be removed, in which case the sprinkler is converted to a full-circle sprinkler. It will also be appreciated that the abutment (30) and stops (32, 34) can be reversed, so that the abutment is carried by the nozzle and the stops are carried by the direction-changing member.

Many other variations, modifications and applications of the invention will be apparent.

What is claimed is:

1. A water sprinkler, comprising:

a nozzle connected to a water supply pipe and discharging the water in the form of a water jet;

a distributor head mounted on the sprinkler for rotary movement with respect to the nozzle and formed with a passageway aligned with the nozzle to receive the water jet therefrom and to direct it outwardly of the sprinkler;

a direction-reversing member pivotally mounted at one end to the distributor head, and including at its opposite end a first surface impinged by the outwardly directed water jet in a first position of the direction-reversing member, and a second surface impinged by the outwardly directed water jet in a second position of the direction-reversing member;

said direction-reversing member further including a third surface contactable with said distributor head for rotating it in one direction when said first surface is impinged by the water jet, and a fourth surface contactable with said distributor head for rotating it in the opposite direction when said second surface is impinged by the water jet;

an abutment mounted on said opposite end of the direction reversing member;

a first stop engageable by said abutment after the distributor head has been rotated a predetermined distance in said first direction, and effective to move said direction-reversing member from said first position to said second position;

and a second stop engageable by said abutment after the distributor head has been rotated a predetermined angular distance in said opposite direction, and effective to move said direction-reversing member from said second position to said first position to rotate the distributor head in said first direction.

2. The sprinkler according to claim 1, wherein said direction-reversing member is pivotably mounted at the rotary axis of the distributor head.

3. The sprinkler according to claim 2, wherein said direction-reversing member is pivotably mounted in a radial slot formed in the distributor head, one side face of said direction-reversing member constituting said third surface and contactable with one side face of said slot for rotating the distributor head in said first direction; the opposite side face of said direction-reversing member constituting said fourth surface and contactable with the opposite side face of said slot for rotating the distributor head in said opposite direction.

4. The sprinkler according to claim 3, wherein said radial slot formed in the distributor head is of generally triangular configuration, and the direction-reversing member is of generally rectangular configuration.

5. The sprinkler according to claim 3, wherein said radial slot formed in the distributor head is of generally rectangular configuration, and the direction-reversing member is of generally triangular configuration.

6. The sprinkler according to claim 3, wherein said distributor head includes two passageways in diametrically opposite sides othereof; two radial slots in alignment to form a diametrical slot; and a direction-reversing member received within said diametrical slot, whereby to produce two diametrically-opposed sector wetting patterns.

7. The sprinkler according to claim 2, wherein said direction-reversing member is pivotably mounted at one end to the distributor along the rotary axis of the distributor head;

the opposite end of said direction-reversing member including a jet-impinging element of triangular configuration with the triangular apex facing the pivotable mounting of the direction-reversing member, such that one side face of the triangular jet-impinging element on one side of said apex constitutes said first surface, and the other side of said triangular jet-impinging element on the other side of said apex constitutes said second surface.

8. The sprinkler according to claim 7, wherein said abutment is in the form of a pin fixed to said jet-impinging element mid-way between its two side faces.

9. The sprinkler according to claim 8, wherein said jet-impinging element and said abutment pin project from opposite faces of said direction-reversing member.

10. The sprinkler according to claim 9, wherein said distributor head is mounted for rotary movement about the vertical axis of the sprinkler between said nozzle and a bracket arm carried by the sprinkler over said nozzle, said passageway formed in the distributor head including an axially extending inlet joined by a curved juncture to a radially extending outlet.

11. The sprinkler according to claim 10, wherein said jet-impinging element projects below said direction-reversing member, and said abutment pin projects above said direction-reversing member.

12. The sprinkler according to claim 11, wherein the rotary mounting of said distributor head includes a stem projecting from its opposite face and rotatably received in a socket formed in the bracket arm overlying said nozzle, said stops being carried by said bracket arm to overlie both said distributor head and said direction-reversing member.

13. The sprinkler according to claim 12, wherein said stops are manually presettable on said bracket arm to different angular positions with respect to said direction-reversing member.

14. The sprinkler according to claim 10, wherein the mounting of said distributor head permits vertical movement of the distributor head with respect to said nozzle, whereby the water jet issuing from the nozzle lifts the distributor head with respect to the nozzle, and the distributor head drops back by gravity when the water supplied to the nozzle is terminated.

15. The sprinkler according to claim 14, wherein the lower end of the distributor head and the upper end of the nozzle are formed with inclined surfaces to center the distributor head with respect to the nozzle when the distributor head drops by gravity onto the nozzle upon the termination of the water supply to the nozzle.

16. The sprinkler according to claim 15, wherein the nozzle is formed with a vertically-extending slot, and the distributor head is formed with a lug received within such slot so as to cause the distributor head first to move in the vertical direction, when the water supplied to the nozzle is first turned on, and then to be pivotted in the lateral direction.

* * * * *